US008207928B2

(12) United States Patent
Johnson et al.

(10) Patent No.: US 8,207,928 B2
(45) Date of Patent: Jun. 26, 2012

(54) METHOD FOR CONTROLLING PIXEL BRIGHTNESS IN A DISPLAY DEVICE

(75) Inventors: Mark T. Johnson, Veldhoven (NL); Nebojsa Fisekovic, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 875 days.

(21) Appl. No.: 10/569,173

(22) PCT Filed: Aug. 20, 2004

(86) PCT No.: PCT/IB2004/002733

§ 371 (c)(1),
(2), (4) Date: Feb. 22, 2006

(87) PCT Pub. No.: WO2005/022499

PCT Pub. Date: Mar. 10, 2005

(65) Prior Publication Data

US 2006/0284894 A1 Dec. 21, 2006

(30) Foreign Application Priority Data

Aug. 27, 2003 (GB) ..... 0319963.5

(51) Int. Cl.
*G09G 3/36* (2006.01)
*G09G 5/10* (2006.01)

(52) U.S. Cl. ..... 345/94; 345/89; 345/691

(58) Field of Classification Search ..... 345/87–104, 345/77, 690–691, 694
See application file for complete search history.

(56) References Cited

U.S. PATENT DOCUMENTS

| | | | | |
|---|---|---|---|---|
| 6,175,355 | B1 * | 1/2001 | Reddy | 345/691 |
| 6,222,515 | B1 * | 4/2001 | Yamaguchi et al. | 345/89 |
| 6,326,941 | B1 * | 12/2001 | Yamazaki et al. | 345/95 |
| 6,429,601 | B1 * | 8/2002 | Friend et al. | 315/169.3 |
| 6,570,554 | B1 * | 5/2003 | Makino et al. | 345/102 |
| 6,590,581 | B1 * | 7/2003 | Koyama et al. | 345/600 |
| 6,828,950 | B2 * | 12/2004 | Koyama | 345/76 |
| 6,836,266 | B2 * | 12/2004 | Kondo et al. | 345/103 |
| 6,982,732 | B2 * | 1/2006 | Suzuki | 345/693 |
| 7,145,536 | B1 * | 12/2006 | Yamazaki et al. | 345/89 |
| 7,176,876 | B2 * | 2/2007 | Kabuto et al. | 345/100 |
| 2002/0003520 | A1 * | 1/2002 | Aoki | 345/87 |
| 2003/0107536 | A1 | 6/2003 | Ishizuka et al. | |

FOREIGN PATENT DOCUMENTS

| | | | |
|---|---|---|---|
| EP | 1271459 | A1 | 1/2003 |
| EP | 1282104 | A1 | 2/2003 |

* cited by examiner

*Primary Examiner* — Bipin Shalwala
*Assistant Examiner* — Keith Crawley

(57) ABSTRACT

The invention relates to an active matrix display device comprising a display with a plurality of display pixels, a data input for receiving a data signal and a controller for distributing said data signal over said display pixels to generate an image on said display with an overall brightness value for each display pixel during at least one frame period. The device is adapted to divide said frame period for at least one subset of said display pixels such that said display pixels of said at least one subset have at least a light output at a first non-zero brightness level during a first sub-period of said frame period and at a second non-zero brightness level during a second sub-period of said frame period, the time averaged sum of said brightness levels being substantially equal to said overall brightness level.

12 Claims, 8 Drawing Sheets

METHOD FOR CONTROLLING PIXEL BRIGHTNESS IN A DISPLAY DEVICE

The invention relates to an active matrix display device comprising:

a display with a plurality of display pixels;

a data input for receiving a data signal;

a controller for distributing said data signal over said display pixels to generate an image on said display with an overall brightness value for each display pixel during at least one frame period.

The display preferably is an emissive display, comprising for example polymer light emitting diodes (PLEDs) or small molecule light emitting diodes (SMOLEDs), or alternatively emissive inorganic electroluminescent elements or field emission devices, or a light shutter display such as an active matrix liquid crystal display (LCD), an electrophoretic display, an electrowetting display or an electrochromic display.

Display devices of the hold type are known to suffer from sample/hold effects. These effects arise from the fact that in every frame period a new image may be displayed at the start of the frame period (sample), whilst in the remainder of the frame period (typically 16 ms for 60 Hz operation) the image remains visible on the display (hold). This effect is experienced by a viewer as a blurred image if moving images are displayed.

The image blurring effect can be reduced by operating the display in a pulsed mode, wherein the frame period is time-divided in two sub-frames. The picture is displayed during only one of these sub-frames. This pulsed mode operation, however, is disadvantageous in that high brightness levels are difficult to achieve.

US2002/0003520 discloses a hold type display device which holds a brightness of the antecedent picture until the subsequent signal is inputted to a pixel, wherein a frame displaying one picture is time divided into multiple sub-frames and the brightness of the subsequent sub-frame is attenuated at a designated ratio according to the brightness of the inputted picture. The thus obtained display device prevents a moving picture from being unclear and blurred and controls the lowering of the brightness in of the picture.

The prior art display device is disadvantageous in that the device is not flexible as to the application, i.e. the display device is not adapted to cope with a variety of situations that may be encountered.

It is an object of the invention to provide a display device that is more flexible.

This object is achieved by an active matrix display device wherein said device is adapted to divide said frame period for at least one subset of said display pixels such that said display pixels of said at least one subset have at least a light output at a first non-zero brightness level during a first sub-period of said frame period and at a second non-zero brightness level during a second sub-period of said frame period, the time averaged sum of said brightness levels being substantially equal to said overall brightness level. The thus obtained display device is more flexible in that particular subsets of display pixels can have light outputs at different brightness levels within the frame time. These subsets can be defined by one or more criteria adapted to the specific situation encountered, including the colours of the display pixels for a colour display, the display pixels belonging to a specific area on the display and/or the total time during which a display pixel has had a light output. Such subsets may e.g. be appropriate for situations wherein only part of the display is likely to suffer from sample/hold effects or where chances of degradation of a set of display pixels is likely because of heavy use.

It is noted here that the light output from the display pixels can be obtained in several ways, including the emission of light by an emissive element of an emissive display and the transmission or reflection of light by a display pixel in a light shutter type display.

In a preferred embodiment, the first brightness level exceeds the second brightness level and/or the first sub-period and the second sub-period are of different duration, such as a first sub-period of shorter duration than said second sub-period. Sample/hold effects are reduced further if the display pixel emits the first brightness level for less than 50% of the frame period if the first brightness level exceeds the second brightness level.

In an embodiment of the invention the active matrix display device is adapted to provide a select signal for selecting said display pixels of said subset, said select signal comprising at least a first select signal triggering said first sub-period and a second select signal triggering said second sub-period. In this embodiment the display pixels of the subset are addressed more than once for each frame period to accomplish the sub-periods by supplying various addressing pulses to these display pixels. In this way the distribution of the brightness levels between the sub-periods can be chosen freely as long as the sum of the brightness levels for the various sub-periods yields the overall brightness.

In an embodiment of the invention the display pixels comprise current emissive elements, such as PLED or SMOLED elements, driven by drive elements and said device is adapted to vary a voltage for said drive elements, such that said at least one subset of current emissive elements is driven to at least said first brightness level during said first sub-period and said second brightness level during said second sub-period. In yet another embodiment of the invention, the display is an active matrix liquid crystal display, said device comprising a backlight and being adapted to control said backlight such that said light output of said display pixels of said at least one subset yields said first brightness level during said first sub-period (F1) and said second brightness level during said second sub-period (F2). In contrast to the previously discussed embodiment concerning the multiple addressing, these embodiments do not require substantial processing of the data signal. The display pixels can be dimmed in the second sub-period whilst only addressing the display pixels once.

In a preferred embodiment the active matrix display comprises a colour display and said backlight is a LED-backlight or a colour sequential backlight. Such a backlight provides the possibility to separate red, green and blue coloured light and provide individual control of these light components as a light input for the display pixels. As such, the colour subset becomes an option for coloured LCD displays.

In an embodiment of the invention the active matrix display device is adapted to generate said light output such that said second brightness level has a brightness that is 30% or less than said first brightness level. Perception studies have revealed that viewers experience an acceptable reduction of motion blur artefacts even if the second brightness level yields a brightness of 30% of the brightness obtained in the first sub-period.

It should be appreciated that the embodiments, or aspects thereof, may be combined.

The invention further relates to an electric device comprising a display device as described in the previous paragraphs. Such an electric device may relate to handheld devices such as a mobile phone, a Personal Digital Assistant (PDA) or a portable computer as well as to devices such as a Personal Computer, a television set or a display on e.g. a dashboard of a car.

British Patent Application No 0316862.2 describes an active matrix display device containing current driven emissive elements. The frame periods for the display are divided in a first sub-period during which the emissive element carries a first non-zero current and a second sub-period during which the emissive element carries a second non-zero current. The first and second non-zero current substantially yield the overall brightness for each display pixel. The patent application does not describe a display device that is adapted to activate subsets of display pixels and thus cannot obtain the flexibility provided by the current invention.

The invention will be further illustrated with reference to the attached drawings, which show preferred embodiments according to the invention. It will be understood that the invention is not in any way restricted to these specific and preferred embodiments.

Figure 1:
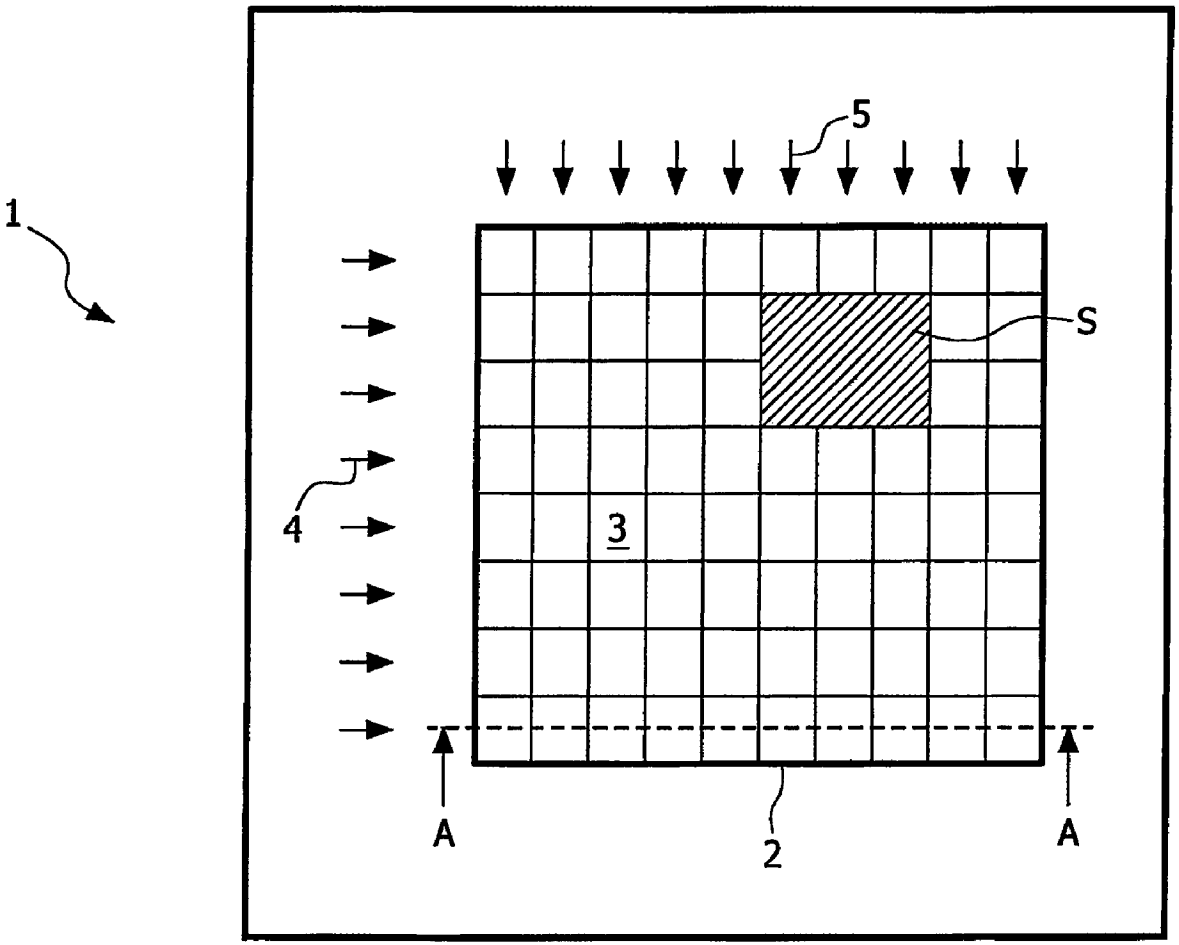
FIG. 1 shows an electric device comprising an active matrix display device according to an embodiment of the invention.

FIG. 1 shows an electric device 1 comprising an active matrix display 2 having a plurality of display pixels 3 arranged in a matrix of rows 4 and columns 5. The display 2 preferably is an emissive display, comprising display pixels 3 containing polymer light emitting diodes (PLEDs) or small molecule light emitting diodes (SMOLEDs), or a light shutter display such as an active matrix liquid crystal display (LCD), an electrophoretic display, an electrowetting display or an electrochromic display. The display 2 may alternatively be a display with emissive inorganic electroluminescent elements or a field emission display device. The display 2 may be a large display as motion artefacts are generally most visible on such large displays. An example of a subset S of display pixels 3 is indicated.

Figure 2:
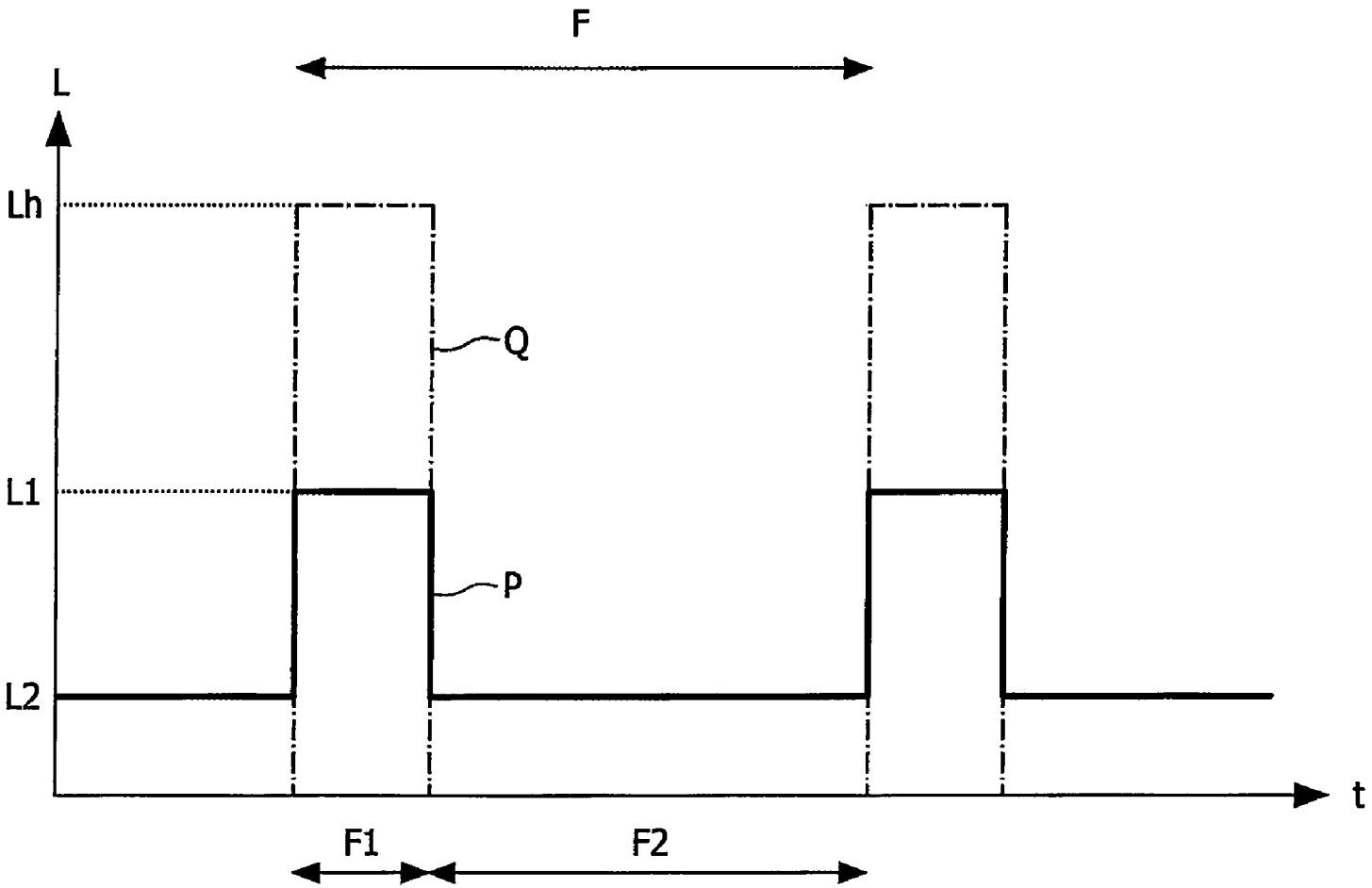
FIG. 2 shows a light output profile according to an embodiment of the invention.

FIG. 2 shows an illustration of a light output profile P according to an embodiment of the invention. The light output profile P is obtained from a subset S of display pixels 3 in a manner that will be described and illustrated below. The frame period F is divided in a first sub-period F1 and a second sub-period F2. The display pixels 3 of the subset S have a light output L at a first brightness level L1 during the first sub-period F1 and at a second brightness level L2 during the second sub-period F2. The time averaged sum of the brightness levels L1 and L2 is substantially equal to the overall brightness level, i.e. the invention achieves the same overall brightness level (=integral area under the profile P) by maintaining a finite non-zero second brightness level L2 such that a first brightness level L1 can be reduced in comparison with the high peak brightness level Lh of the dashed profile Q representing a conventional reduced duty cycle profile for a display. This allows for the adaptation of the light output L for only a subset S of display pixels 3 to e.g. modify the quality wherein the image can be displayed. Perception studies have revealed that motion blur artefacts are perceived as being reduced even if L2 is 30% or less than L1.

It is noted that the profile P in FIG. 2 only illustrates a simple example. More complex profiles may be generated, including varying light outputs L1 in subsequent frame periods F, the light output L2 being kept at a fixed or variable ratio or a stable level for the sub-period F2, and multiple sub-periods F1, F2, . . . Fn having corresponding non-zero brightness levels L1, L2, . . . Ln. The sub-periods F1 and F2 may be of different duration.

Figure 3C:
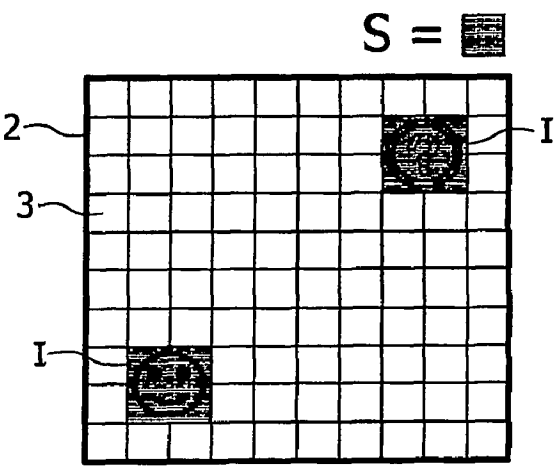
FIGS. 3A-3C show various examples of subsets of display pixels according to different embodiments of the invention.
Figure 3B:
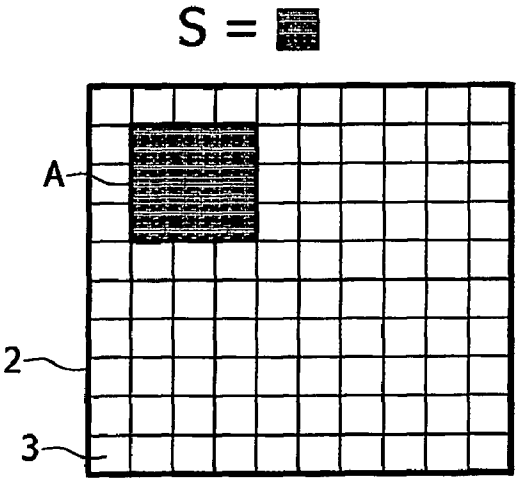
Figure 3A:
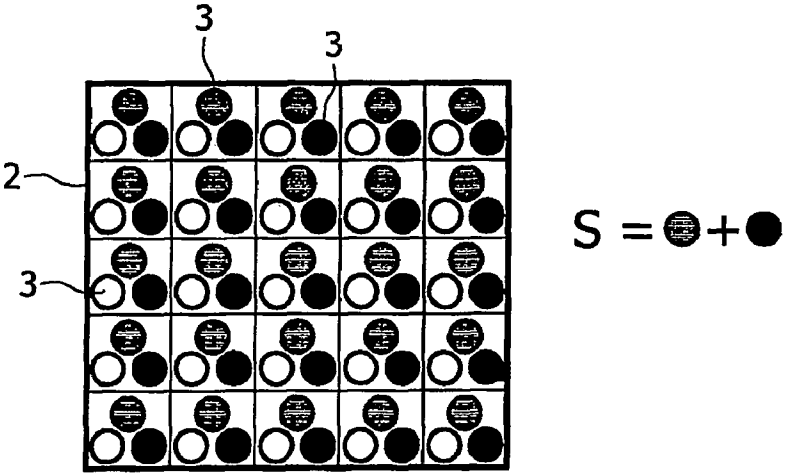

FIGS. 3A-3C show three examples of subsets S of display pixels 3 for which the frame period F is time-divided in a first sub-period F1 during which L1 is obtained and a second sub-period F2 during which L2 is obtained.

FIG. 3A shows a colour display 2 that may e.g. comprise sub-pixels 3 applying red (white circles), green (light-grey circles) or blue (dark-grey) emissive elements. The subset S consists e.g. of the red (R) and blue (B) display pixels 3 as green display pixels 3 may e.g. be more light efficient and exhibit extremely long lifetimes. According to an embodiment of the invention the subset S of R and B display pixels 3 yields a light output L in accordance with the profile P of FIG. 2, whereas the G display pixels 3, for which the driving method is less needed, yield a light output in accordance with the profile Q. In this way driving is simplified and the sample/hold effect is further reduced.

In another example the subset S consists of said green sub-pixels G 3 only, while the R and B display pixels 3 are driven in a non-pulsed mode, i.e. the R and B display pixels 3 yield a constant light output over the frame period F. In this way, driving is further simplified, the display lifetime is extended as the red and blue emissive elements do not experience high currents and an acceptable image perception is maintained reducing the sample/hold effects of the (dominant) green elements.

FIG. 3B shows an example wherein the subset S is defined as the display pixels 3 of a particular area A. This area A may e.g. be a window displaying a video on a stationary background. As sample/hold effects only occur in the area A of moving images in such a situation, an embodiment of the invention allows a division of the frame period F into frame sub-periods F1 and F2 with a first brightness level L1 and a second brightness level L2 respectively, only for the area A. It is noted that area A may vary in position on the display and more than one area A may be present. The display pixels not belonging to the subset S may be driven in another mode, e.g. to yield a constant light output.

FIG. 3C shows an example wherein the subset S is defined as the display pixels 3 that output light for the longest times. If the display 2 e.g. continually displays icons I, the display pixels 3 displaying this icon I have a long on-time. If a display 2 comprises current emissive elements it is known that these elements degrade in performance with time. This degradation is slowed down by defining these pixels as the subset S and dividing the frame period F in a first sub-period F1 during which a first brightness level L1 is output and a second sub-period F2 during which the second brightness level L2 is output. Alternatively, to further slow down the degradation, the icon pixels could be driven at a constant light output whilst other pixels could be driven with a profile P in FIG. 2.

It is explicitly noted here that other types of subsets S can be envisaged without departing from the true spirit of the invention.

Next several examples of types of displays 2 will be discussed as well as some examples for the implementation of the embodiments of the invention, discussed with respect to FIGS. 2 and 3, in these types of displays 2.

Figure 4:
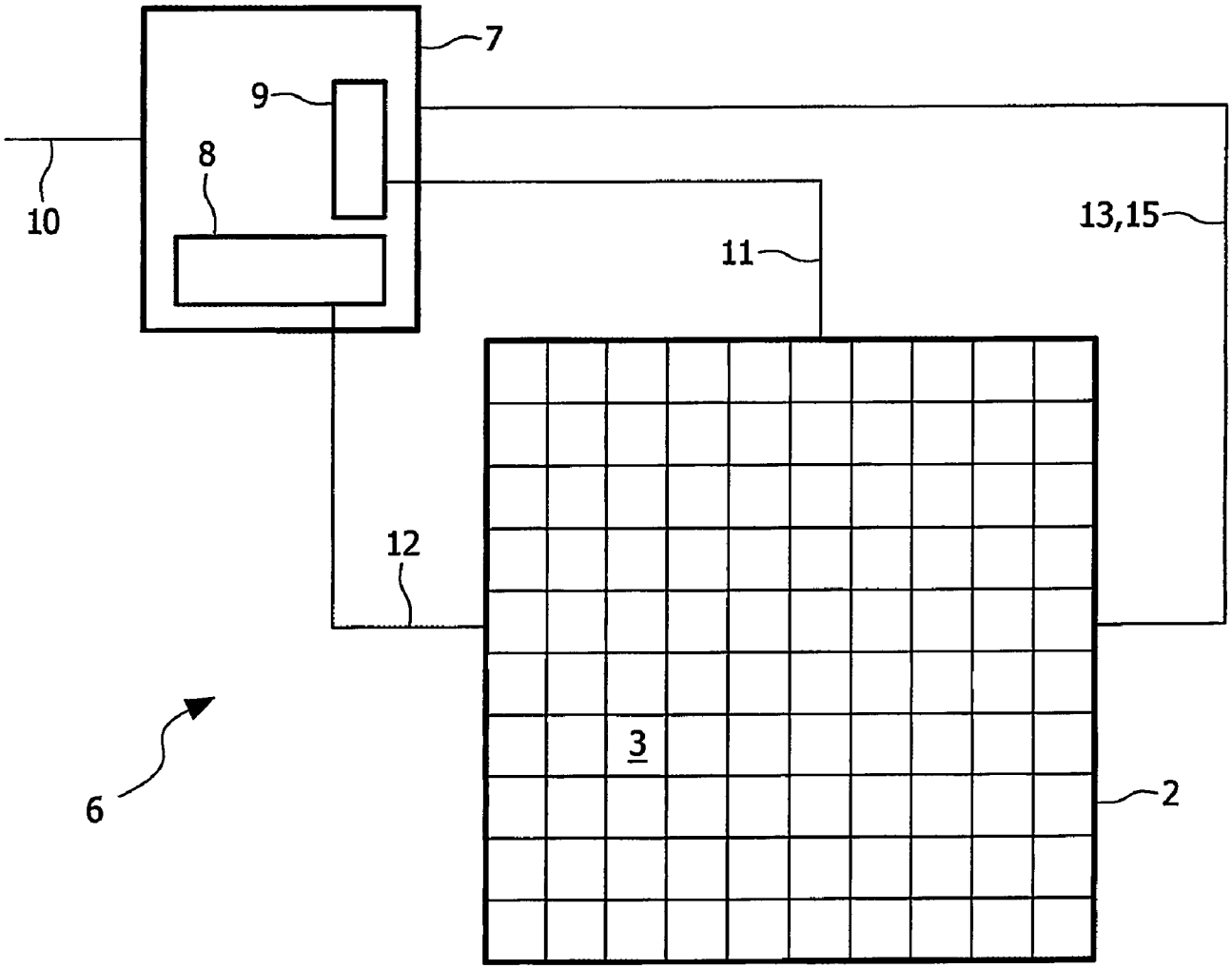
FIG. 4 shows a schematical illustration of an active matrix display device shown in FIG. 1, comprising a display with current emissive elements according to an embodiment of the invention.
Figure 5:
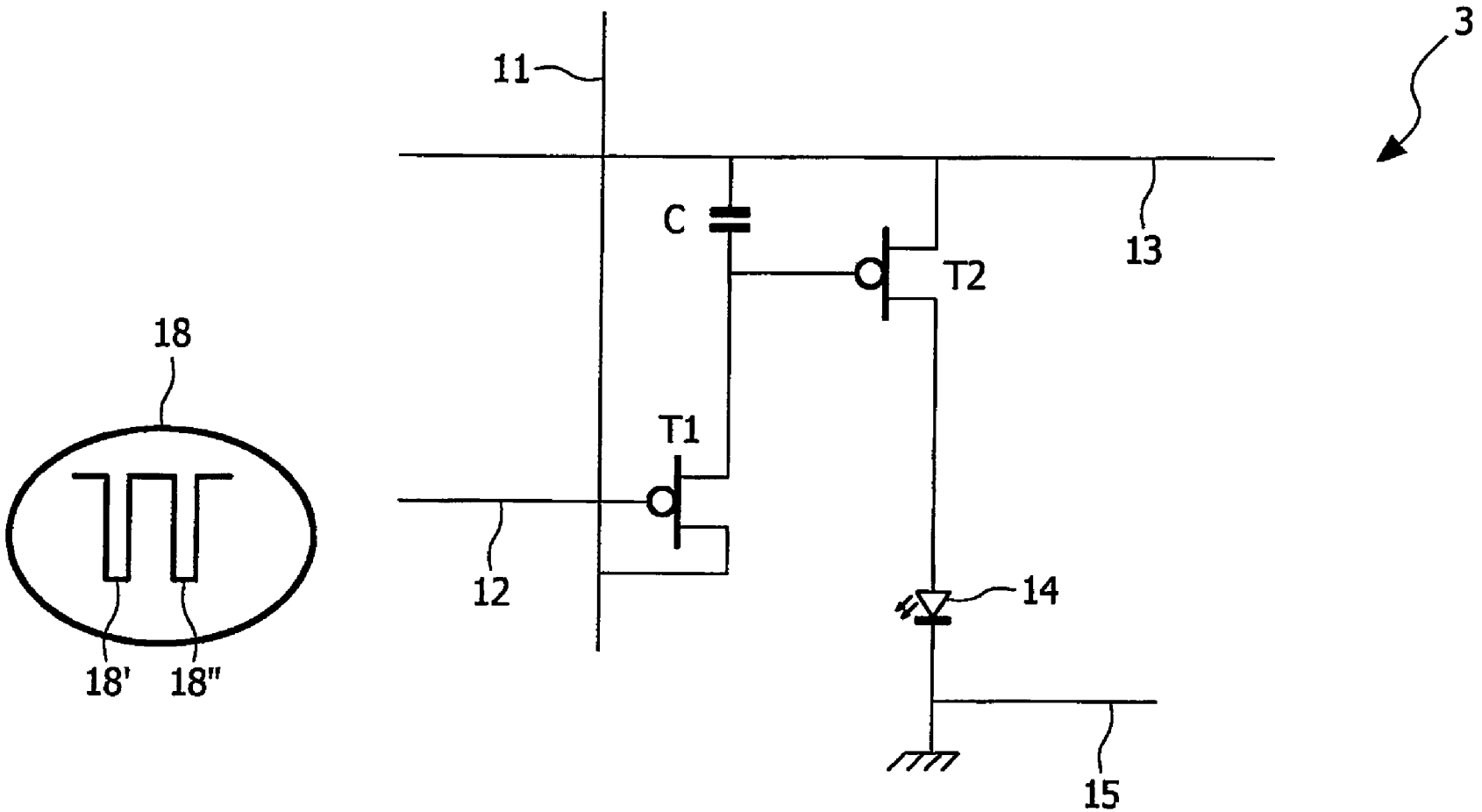
FIG. 5 shows a voltage addressed display pixel for a display shown in FIG. 4, according to an embodiment of the invention.
Figure 6:
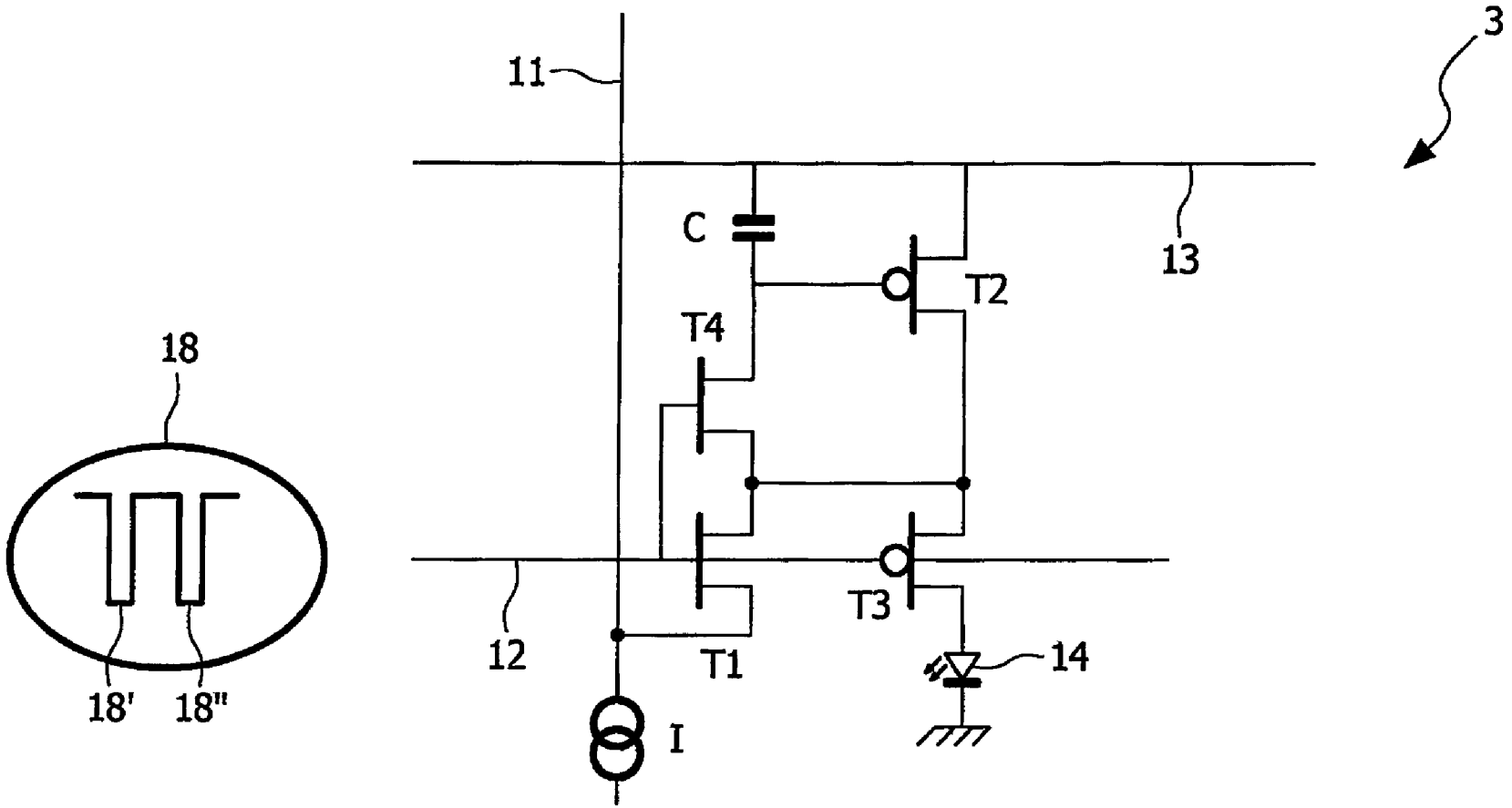
FIG. 6 shows a current addressed current mirror display pixel for a display shown in FIG. 4, according to an embodiment of the invention.

FIG. 4 shows a schematical illustration of an active matrix display device 6, comprising an OLED display 2 of the electric device 1 as shown in FIG. 1 having current emissive elements shown in detail in FIG. 5 and FIG. 6). The display 2 comprises a display controller 7, including amongst others a row selection circuit 8 and a data register 9. A data signal, comprising information or data such as (video) images to be presented on the display 2, is received via data input 10 by the display controller 7. The data are written to the appropriate display pixels 3 from the data register 8 via data lines 11. The selection of the rows 4 of the display pixels 3 is performed by the row selection circuit 8 via selection lines 12, controlled by the display controller 7. Synchronization between selection of the display pixels 3 and writing of the data to the display pixels 3 is performed by the display controller 7. Moreover the display controller 7 controls the power supply of the display pixels 3 via power lines 13, 15.

FIGS. 5 and 6 show two examples of circuit arrangements for the display pixels 3 for the active matrix display device 6.

FIG. 5 shows a voltage addressed circuit arrangement for a display pixel 3 comprising an addressing transistor T1, a storage capacitor C and a drive element T2 for applying a driving signal to a current driven emissive element 14. The transistor T1 is arranged to receive a select signal over the line 12 from the display controller 7. T1 passes the data signal for a particular frame to the gate of T2 if an appropriate select signal is received. T2 may be a p-Si thin film transistor (TFT) and the current driven emissive element 14 may be a light emitting diode, such as an polymer light emitting diode (PLED) or small molecule organic light emitting diode (SMOLED). The current emissive element 14 may e.g. emit red, blue or green light. One of the plates of the capacitor C and the source electrode of T2 are connected to the power supply line 13. A voltage may be applied to T2 as well via line 15.

If T2 is biased in saturation it behaves as a constant current source, passing a current which is proportional to $\mu_{fe}.(V_{GS}-V_T)^2$ where $V_{GS}$ is the gate-source voltage of T2, $V_T$ the threshold voltage, and $\mu_{fe}$ is the field effect mobility of T2. This constant current is then driven through the emissive element 14 which is connected to T2. Thus, the current source is programmed by setting the voltage on the gate of T2. This is conventionally achieved during a short addressing time of e.g. 25 μs by turning on T1 via line 12 and transferring the signal voltage from the data register 9 to the gate of T2. T1 is then switched off, and the programmed voltage is held on the gate of T2 for the rest of the frame period F. The storage capacitor C prevents appreciable discharge of this node via leakage through T1, thus forming a memory to allow continuous LED current while the other rows 4 of the display 2 are selected sequentially. It is noted that voltage addressed display pixels 3 are known in many variants that may employ further transistors. Such variants fall under the scope of the present invention.

Another category of display pixel circuits are the current addressed display pixel circuits 3 shown in FIG. 6. The driving transistor T2 is used in both addressing the display pixel 3 and in driving the emissive element 14. T2 preferably is a short channel TFT for reasons described in the co-pending application British Patent Application No 0316862.2 ("Display device") of the applicant that is incorporated in the present text by reference with respect to this feature. The data input signal is applied as a current rather than as a voltage over the line 11, indicated by the current source 1. During the addressing period the driving transistor T2 is diode-connected by the transistor T4 to addressing transistor T1, and the emissive element 14 is isolated from the circuit by the transistor T3. During this addressing period the data input current is forced through T2 while the capacitor C is charged to reach the associated gate-source voltage $V_{GS}$ for T2. Now, by opening T1 and T4 and by closing T3, the drain current is fed to the emissive element 14. The memory function of the capacitor C assures the current to be a perfect copy of the data input current received over line 11.

In operation the display controller 7 may generate a select signal 18 in an embodiment of the invention and provide this select signal 18 over the select lines 12 to a subset S of display pixels. The select signal 18 comprises a first select signal 18' triggering the first sub-period F1 and a second select signal 18" triggering the second sub-period F2 shown in FIG. 2. The display pixel 3 is thus voltage- or current addressed more than once for each frame period F by supplying various addressing pulses to the selecting means T1 and T1, T3, T4 respectively. The display controller 7 may determine the display pixels 3 belonging to the subset S, process the data signal received over input 10 and distribute this data signal for the frame period F as a first brightness level L1 output during the first sub-period F1 and a second brightness level L2 output during the second sub-period F2. Double addressing can also be accomplished by providing an additional addressing line 12 for each display pixel 3 to save power and addressing time.

In another embodiment the display controller 7 may vary the voltage for the drive element T2 such that during the first sub-period F1 a first current I1 is applied to the emissive element 14 to yield the brightness level L1 and subsequently, during the sub-period F2, a second current I2 to yield the brightness level L2. This can be performed by controlling the power supply over line 13 or 15 for the subset S of display pixels 3, determined by the controller 7 for the situation encountered. If e.g. the display 2 is a colour display the display device 6 may accomplish the situation as was described for FIG. 3A as follows.

Typically a coloured display pixel 3 comprises a red, green and blue emissive element 14 whereas the display device 6 is adapted to drive these emissive elements independently of each other. It was observed that some of the emissive elements 14 are more efficient than others in term of light output and moreover that the lifetime of emissive elements may vary considerably from colour to colour. Particularly green emissive organic light emitting diodes yield a high light output L, i.e. more light per electron, and show extremely long lifetimes. Therefore in an embodiment of the invention the display 2 comprises a subset S of display pixels 3 or emissive elements 14 and said device 6 supplies a first non-zero current and a second non-zero current to only the red and blue display pixels 3 of the subset S by addressing these pixels 3 twice applying select signals 18' and 18" in the frame period F. Alternatively the voltages for the drive elements T2 can be varied via lines 13 or 15 of the R and B display pixels 3 of the subset S.

As another example only the green emissive elements 14 are manipulated, e.g. by varying the voltage for the drive elements T2 of these G display pixels 3 during the frame period F, while the red and blue emissive elements 14 are simply driven continuously at a constant light output during this frame period F. In this way the driving of the display 2 is simplified even further and the lifetime of the display 2 is extended as the red and blue emissive elements 14 experience no high current pulses. Sample/hold effects are reduced by perception by solely manipulating the dominant green emissive elements 14.

A similar operation may be applied for emissive types of display 2 in creating the subsets S shown in FIGS. 3B and 3C. The controller 7 may e.g. register the total time during which a display pixel 3 has been on and define a threshold time above which the display pixel is determined as belonging to the subset S. The light output L of these display pixels 3 of the subset S should yield the light output profile P to prolong the lifetime of these display pixels 3.

Figure 7:
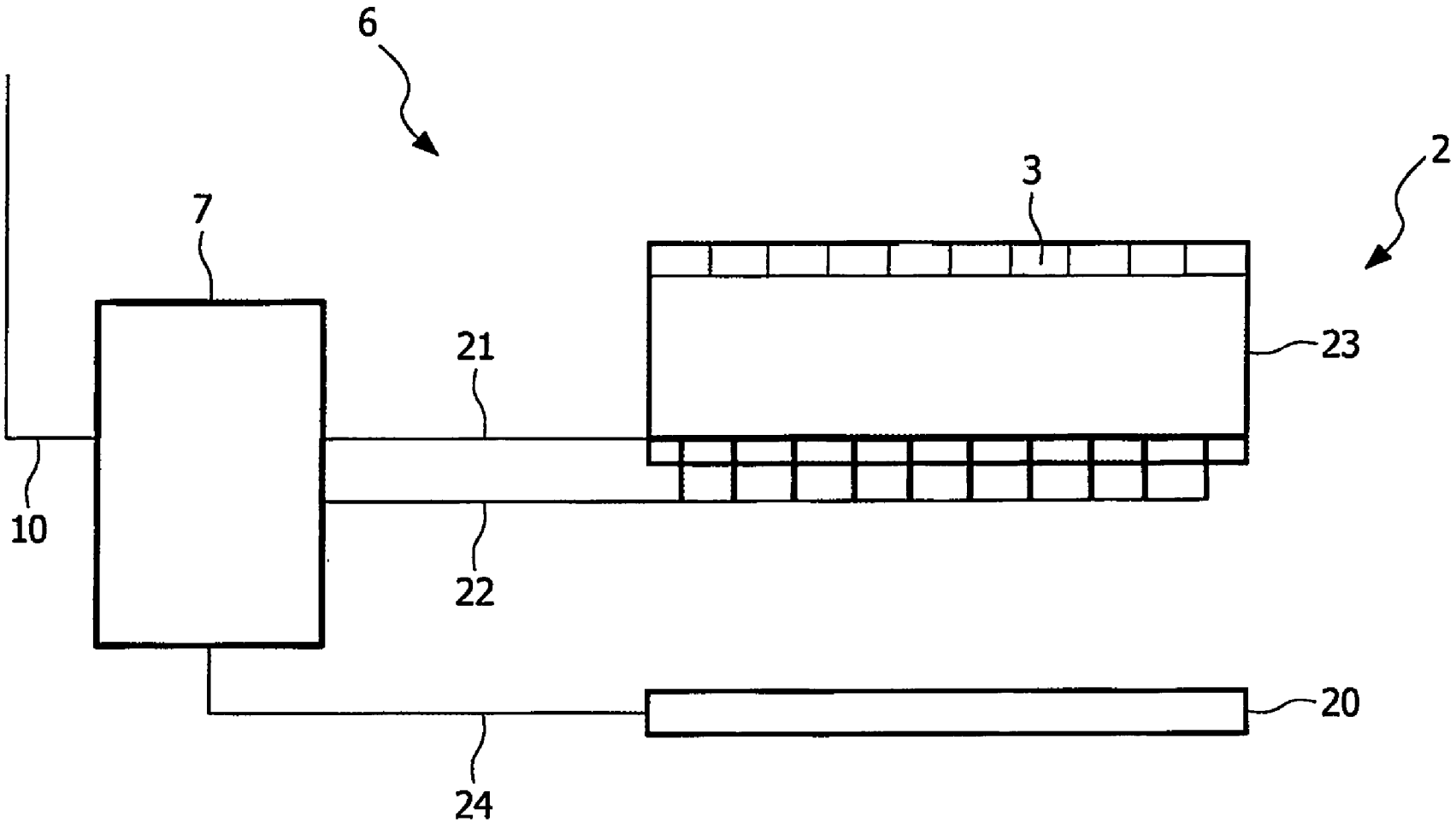
FIG. 7 shows a schematical illustration of an active matrix display device along cross-section A-A in FIG. 1, comprising a liquid crystal display according to an embodiment of the invention.

FIG. 7 schematically shows an active matrix display device, 6 along cross-section A-A in FIG. 1, having an LCD display 2 with display pixels 3. Light may be generated from a backlight 20. The backlight 20 may e.g. be a normal white backlight, a backlight employing light emitting diodes (especially useful to employ coloured subsets S as shown in FIG. 3A) or a sequential colour backlight. Alternatively the backlight 20 may be replaced by a reflector reflecting ambient light to the display pixels 3. The display 2 comprises a grid of conductive address lines 21 and drive lines 22 connected to active circuitry (not shown) to control and switch liquid crystal elements in part 23 of the display 2 by a controller 7. The controller 7 determines the polarization states of the liquid crystal elements in the part 23 and, as a consequence of this, the light output L of the display pixels 3. The controller 7 may also control the backlight 20 over line 24 depending on the kind of backlight employed. Other components, such as e.g. conventionally applied glass plates, polarizing filters and/or colour filters are not shown in FIG. 7 for reasons of clarity.

In an embodiment of the invention the display device 6 of FIG. 7 may operate as follows. The controller 7 monitors a video data signal at the data input 10 to be displayed in a window A (see FIG. 3B). The display pixels 3 belonging to this window A are defined as the subset S as determined by the controller 7. The light output profile P for the display pixels 3 of the subset S is suitable to decrease the perception of motion blur artefacts, as was previously described. This light output profile P may be obtained by dividing the frame period F in sub-periods F1, F2 by e.g. addressing the display pixels 3 of the subset S twice over line 21. The polarization state of the liquid crystal elements is controlled via the lines 22 such that the output brightness level L1 is obtained during the first sub-period F1, while the polarization state is switched to obtain the second brightness level L2 during the second frame period F2. The display pixels 3 not belonging to the subset S may e.g. be driven such that their light output profile is constant. Alternatively for a colour LCD 2, the subset S can be defined by solely the green display pixels 3. The green display pixels may be driven to yield the profile P, while e.g. the blue display pixels 3 may be driven to yield the profile Q and the red display pixels yield a continuous light output L over the entire frame period F. These embodiments provide the advantage that less signal processing is needed in the controller 7 compared to the display device of US 2002/0003520.

In yet another embodiment of the invention the controller 7 controls the backlight 20 over line 24 to yield the light output profile P for the LCD 2 shown in FIG. 2. If the backlight 20 is a LED backlight or a coloured sequential backlight, the controller 7 may control the colour and the brightness level L1, L2 of the light that is input to the display 2 whilst the display pixels are only addressed once.

Figure 8:
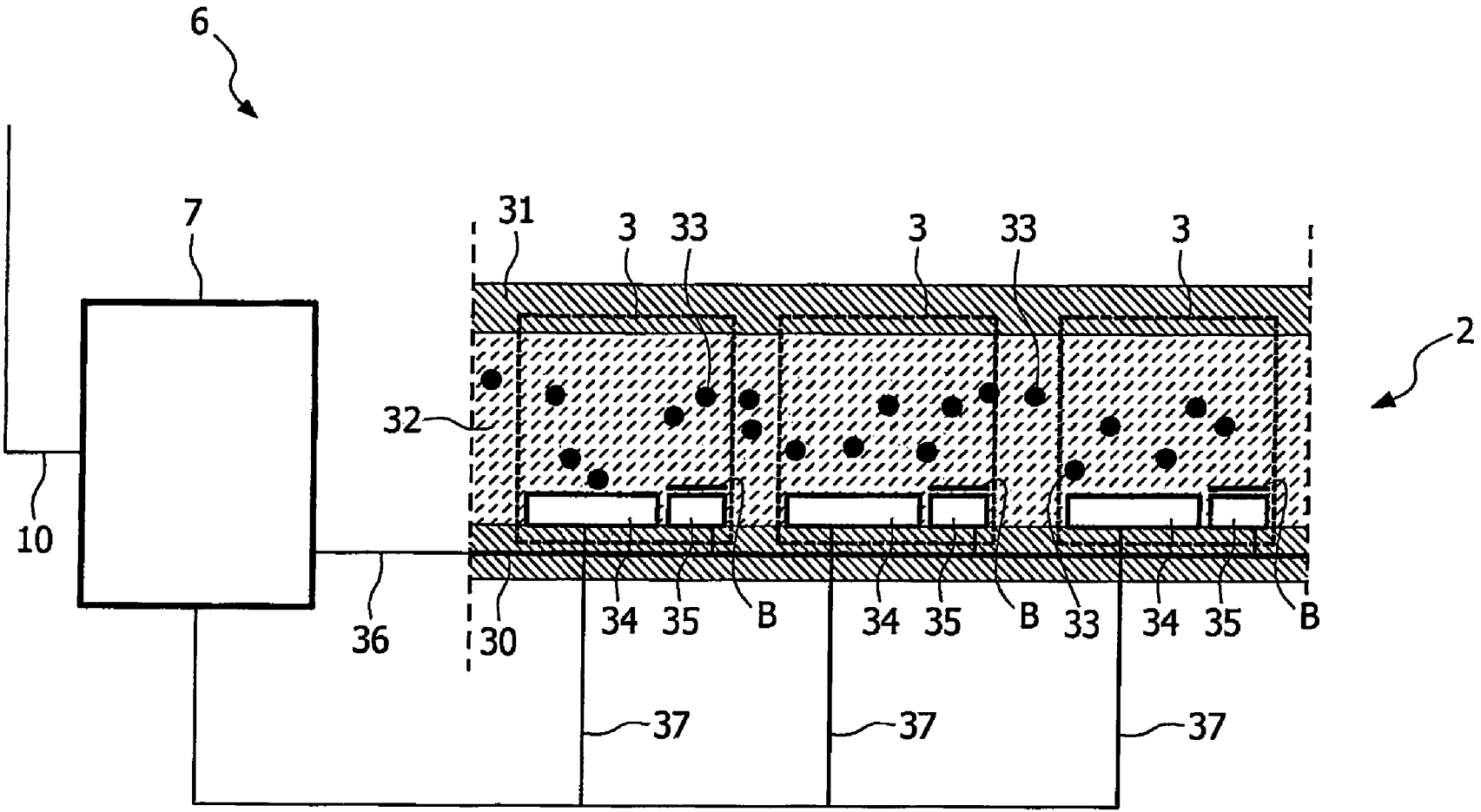
FIG. 8 shows a schematical illustration of an active matrix display device along cross section A-A in FIG. 1, comprising an electrophoretic display.

FIG. 8 shows another embodiment, as part of cross-section A-A as defined in FIG. 1, of a display device 6 comprising an electrophoretic display 2 to which the invention can be applied. The display device 6 comprises a first substrate 30, a second opposed substrate 31 and a plurality of display pixels 3. Preferably, the display pixels 3 are arranged along substantially straight lines in a two-dimensional structure as shown in FIG. 1. Other alternatives include e.g. a honeycomb structure. An electrophoretic medium 32, having charged particles 33, is present between the substrates 30 and 31. The first substrate 30 has for each display pixel 3 a transparent first electrode 34, and a second electrode 35. The second electrode is covered with a non-transparent black matrix B. A controller 7 comprises a data signal input 10 for receiving the data signal. The controller 7 distributes the data signal over the display pixels 3 to generate an image on the display 2 via the conductive lines 36,37, active circuitry (not shown) in the substrate 30 and the electrodes 34, 35. The charged particles 33 are able to occupy extreme positions near the electrodes 34,35 and intermediate positions in between the electrodes 34,35. In this way grey levels can be obtained depending on the voltage applied over the electrodes 34,35. Each display pixel 3 has a brightness level L determined by the position of the charged particles 33 between the electrodes 34,35 for displaying the picture or image. As an example, the electrophoretic medium 32 comprises negatively charged black particles 33 in a transparent fluid, situated above a white background. When the charged particles 33 are in a first extreme position, e.g. near the first electrode 34, as a result of the potential difference being e.g. 15 Volts, the appearance of the display pixel 3 is e.g. black. Here it is considered that the display pixel 3 is observed from the side of the second substrate 31. When the charged particles 33 are in a second extreme position, i.e. near the second electrode 35, as a result of the potential difference being of opposite polarity, i.e. −15 Volts, the appearance of the display pixel 3 is white. When the charged particles 33 are in one of the intermediate positions, i.e. in between the electrodes 34,35 the display pixel 3 has one of the intermediate appearances, e.g. light grey and dark grey, which are grey levels between white and black. The electrophoretic display 2 may be used with the backlight options discussed above.

In operation the electrophoretic display 2 may e.g. display a moving image in a window A. The display pixels 3 positioned in this window A are defined as constituting the subset S for which the frame period F is to be time divided in a sub-period F1 and F2. This division may be accomplished by double addressing of the display pixels 3 via the line 36. The light output profile P as shown in FIG. 2 is obtained by applying a first drive voltage to the charged particles 33 during the first sub-period F1 to obtain the first brightness level L1 and a second drive voltage during the second sub-period F2 to obtain a light output a the second brightness level.

The invention claimed is:

1. Active matrix display device (6) comprising:

a display (2) with a plurality of display pixels (3);

a data input (10) for receiving a data signal;

a controller (7) for distributing said data signal over said display pixels (3) to generate an image on said display (2) with an overall brightness level, during at least one frame period (F), wherein said device (6) is adapted to:

divide said frame period (F) into only a first subperiod and an adjacent second subperiod for at least one subset (S) of said display pixels (3) such that said display pixels (3) of said at least one subset (S) have at least a light output (L) at a first non-zero brightness level (L1) for a duration of the first sub-period (F1) of said frame period (F) and at a second non-zero brightness level (L2) for a duration of the second sub-period (F2) of said frame period (F), wherein the first and second levels of brightness are selected so that the time averaged sum of said brightness levels (L1,L2) of said pixels within said at least one subset (S) is substantially equal to said overall brightness level of said image in said at least one subset (S), said second level being maintained a stable level during the second sub period and the first and second levels being in a known ratio.

2. Active matrix display device (6) according to claim 1, wherein said display (2) is a colour display and said subset (S) is defined by colour (R, G, B).

3. Active matrix display device (6) according to claim 1, wherein said device (6) is adapted to determine one or more particular areas (A) of said display and said subset is defined by said areas.

4. Active matrix display device (6) according to claim 1, wherein said device (6) is adapted to determine the total time during which said display pixels (3) have had a light output and said subset (S) is defined by said total time.

5. Active matrix display device (6) according to claim 1, wherein said first brightness level (L1) exceeds said second brightness level (L2).

6. Active matrix display device (6) according to claim 1, wherein said first sub-period (F1) has a shorter duration than said second sub-period (F2).

7. Active matrix display device (6) according to claim 1, wherein said device (6) is adapted to supply a select signal (18) for selecting said display pixels (3) of said subset (S), said select signal (18) comprising at least a first select signal (18') triggering said first sub-period (F1) and a second select signal (18") triggering said second sub-period (F2).

8. Active matrix display device (6) according to claim 1, wherein said display pixels (3) comprise current emissive elements (14) driven by drive elements (T2) and said device (6) is adapted to vary a voltage (13; 15) for said drive elements (T2) such that said at least one subset (S) of current emissive elements (14) is driven to at least said first brightness level (L1) during said first sub-period (F1) and said second brightness level (L2) during said second sub-period (F2).

9. Active matrix display device (6) according to claim 1, wherein said display (2) is an active matrix liquid crystal display, said device (6) comprising a backlight (20) and being adapted to control said backlight (20) such that said light output (L) of said display pixels (3) of said at least one subset (S) yields said first brightness level (L1) during said first sub-period (F1) and said second brightness level (L2) during said second sub-period (F2).

10. Active matrix display device (6) according to claim 9, wherein said display (2) is a colour display and said backlight (20) is a LED-backlight or a colour sequential backlight.

11. Active matrix display device (6) according to claim 1, wherein said device (6) is adapted to generate said light output (L) such that said second brightness level (L2) has a brightness that is 30% or less than said first brightness level (L1).

12. Electronic device (1) comprising an active matrix display device (6) comprising:

a display (2) with a plurality of display pixels (3);

a data input (10) for receiving a data signal;

a controller (7) for distributing said data signal over said display pixels (3) to generate an image on said display (2) with an overall brightness level during at least one frame period (F), wherein said device (6) is adapted to divide said frame period (F) into only a first subperiod and an adjacent second subperiod for at least one subset (S) of said display pixels (3) such that said display pixels (3) of said at least one subset (S) have at least a light output (L) at a first non-zero brightness level (L1) for a duration of the first sub-period (F1) of said frame period (F) and at a second non-zero brightness level (L2) for a duration of the second sub-period (F2) of said frame period (F), wherein the first and second levels of brightness are selected so that the time averaged sum of said brightness levels (L1,L2) of said pixels within said at least one subset (S) is substantially equal to said overall brightness level of said image within said at least one subset (S) wherein said second level being maintained a stable level during the second sub period and the first and second brightness levels being in a known ratio.

* * * * *